US006835454B1

(12) United States Patent
Randa et al.

(10) Patent No.: US 6,835,454 B1
(45) Date of Patent: Dec. 28, 2004

(54) FLUOROPOLYMER MODIFICATION OF STRINGS FOR STRINGED SPORTS EQUIPMENT AND MUSICAL INSTRUMENTS

(76) Inventors: Stuart Karl Randa, 213 W. Pembrey Dr., Wilmington, DE (US) 19803; James M Fitzgerald, 121 Bromley Dr., Wilmington, DE (US) 19805

( * ) Notice: Subject to any disclaimer, the term of this patent is extended or adjusted under 35 U.S.C. 154(b) by 445 days.

(21) Appl. No.: 09/616,447

(22) Filed: Jul. 14, 2000

Related U.S. Application Data

(60) Provisional application No. 60/150,435, filed on Aug. 24, 1999.

(51) Int. Cl.[7] ..... D02G 3/00

(52) U.S. Cl. ..... 428/373; 428/364; 428/375; 428/378; 428/394

(58) Field of Search ..... 428/364, 375, 428/378, 394, 395, 373

(56) References Cited

U.S. PATENT DOCUMENTS

| | | | | | |
|---|---|---|---|---|---|
| 4,377,620 | A | | 3/1983 | Alexander | 428/372 |
| 4,382,358 | A | | 5/1983 | Tappe et al. | |
| 5,536,005 | A | * | 7/1996 | Koff | 273/73 R |
| 5,637,663 | A | | 6/1997 | Anolick et al. | 526/254 |
| 5,801,319 | A | * | 9/1998 | Hebestreit et al. | 84/297 |
| 5,863,298 | A | | 1/1999 | Fulton et al. | 8/138 |
| 5,883,319 | A | * | 3/1999 | Hebestreit et al. | 84/297 |
| 5,907,113 | A | * | 5/1999 | Hebestreit et al. | 84/297 R |
| 6,248,942 | B1 | * | 6/2001 | Hebestreit et al. | 84/297 |
| 6,348,646 | B1 | * | 2/2002 | Parker et al. | 84/297 R |
| 2001/0000857 | A1 | * | 5/2001 | Hebestreit et al. | 84/120 |
| 2001/0035002 | A1 | * | 11/2001 | Carr | 57/244 |

FOREIGN PATENT DOCUMENTS

| | | | |
|---|---|---|---|
| DE | 3133231 | | 3/1983 |
| DE | 3619447 | A1 | 12/1986 |
| DE | 4327329 | A1 | 2/1995 |
| EP | 0086285 | A1 | 8/1983 |
| EP | 257424 | | 3/1988 |
| EP | 0775994 | A2 | 5/1997 |
| EP | 0911347 | A2 | 4/1999 |
| EP | 1081270 | A1 * | 3/2001 |
| JP | 040810149 | | 12/1992 |
| JP | 06218081 | | 11/1994 |
| WO | WO 97/37342 | | 10/1997 |

* cited by examiner

*Primary Examiner*—Rena Dye
*Assistant Examiner*—J. M. Gray

(57) ABSTRACT

The modification of strings for sports equipment and musical instruments and other stringed devices by coating with fluoropolymer coatings to reduce the coefficient of friction of the string surfaces and to reduce the internal friction of the string components among themselves.

13 Claims, No Drawings

FLUOROPOLYMER MODIFICATION OF STRINGS FOR STRINGED SPORTS EQUIPMENT AND MUSICAL INSTRUMENTS

RELATED APPLICATION

This application claims benefit of U.S. Provisional Application 60/150,435, filed Aug. 24, 1999.

FIELD OF THE INVENTION

This invention is in the field of treatment of strings for sports equipment or musical instruments to reduce their coefficients of friction.

BACKGROUND OF THE INVENTION

In the case of sports equipment such as tennis racquets, easy relative movement of strings on surfaces, in guides, grooves, sheaves, and eyes, and against other strings is often desirable. Low friction facilitates stringing of the racquet and reduces wear and abrasion during use, and improves performance by allowing the smooth stretching and contraction of the strings under impact. For example, tennis racquets function better if the strings move smoothly and easily relative to one another. This increases the time the ball is in contact with the racquet, reduces the shock of impact, and improves the control the player exercises over the direction and the spin of the ball. Wear is reduced and string life increased. Similarly, other stringed devices, such as musical instruments and fishing rods and reels, are more easily assembled, adjusted, and used when the strings move smoothly and with minimum friction against each other and in the various guides, supports, sheaves, and eyes that characterize the devices.

A number of ways have been proposed to modify strings to reduce their coefficients of friction and facilitate their movement. These include application of lubricants (U.S. Pat. No. 5,863,298), coating with dispersions of particles of TEFLON® resin (U.S. Pat. No. 4,377,620; Japanese Patent no. 4-80149), coating with molten polyamide or polyester containing particles of TEFLON® resin (U.S. Pat. No. 4,377,620), and melt-extruding fluoropolymer resin onto strings (European Patent no. 257424). Lubricants though slippery, are soft and fugitive, picking up dust and dirt. Lubricants also have a tendency to transfer to whatever comes in contact with the lubricated string. Particles of TEFLON® resin are hard, do not adhere well to any substrate, and can be made to melt, flow, and coalesce, if at all, only at temperatures near or above the melting points of polymers used in making racquet strings, such as nylon. Using TEFLON® resin particles in binders such as polyamides requires high temperature for application, and the resulting coating, being composed of TEFLON® resin and binder, does not have the low coefficient of friction of the fluoropolymer used alone. Extruded coatings of fluoropolymers have good friction properties, but even higher temperatures are necessary in melt extrusion, 300 to 400° C., and because of the viscosity of the molten polymer, the coating thickness is on the order of 25 $\mu$m or greater. The high temperature limit the materials of which the string can be made, and the thickness of the coating is a disadvantage, affecting the properties of the coated string, and requiring the use of a large mass of relatively expensive fluoropolymer when only the beneficial surface property, that is, the low coefficient of friction of the fluoropolymer, is needed. Furthermore, the fluoropolymer coatings do not adhere well to the string.

Low coefficient of friction is beneficial also for the interior surfaces of composite strings, that is, strings that are made up of smaller strings, or filaments or fibers. Such strings benefit if the components can move easily with respect to one another when forces are applied, such as by impact. Tennis strings are often composed of a central monofilament or multifilament strand around which are wound or braided smaller mono- or multifilament strands, with a jacket around the whole. Elasticity is improved if there is little or no friction within the strings themselves. U.S. Pat. No. 4,382,358 describes a string comprising a monofilament of a copolymer of polyvinylidene fluoride. Japanese Patent no. 6-218081 describes a composite string as a core-sheath structure, comprising a nylon core and a sheath in which at least some of the filaments are made of polymer containing fluorine. These patents teach the use of fluoropolymers as components of the composite string. However, this requires excessive amounts of fluoropolymer in the case where only a surface property, that is the low coefficient of friction, of fluoropolymer is wanted.

There is a need for very thin, adherent, easily applied coatings having low coefficients of friction for strings in sports racquets and other stringed devices, such as musical instruments and fishing rods and reels. Furthermore, there is a need for treatments that permit the component strands of composite strings to move easily with respect to one another, that is, to reduce friction at the interior surfaces of composite strings.

SUMMARY OF THE INVENTION

An object of the present invention is to provide strings for stringed devices, such as sports racquets and musical instruments, having low coefficients of friction in order to optimize operation and lifetime of the strings in the stringed devices.

In one embodiment, the present invention is directed to a coated string comprising: (a) an first coating of fluoropolymer having recurring units containing polar functional groups coated on the string; and (b) a second coating of fluoropolymer having recurring units containing no polar functional groups surrounding the first coating.

In another embodiment, the present invention is directed to a sports racquet strung with a coated string comprising: (a) an first coating of fluoropolymer having recurring units containing polar functional groups coated on the string; and (b) a second coating of fluoropolymer having recurring units containing no polar functional groups surrounding the first coating.

In another embodiment, the present invention is directed to a composite string having component strands, wherein said component strands are coated with fluoropolymer coating. In a preferred embodiment, the composite string comprises a first coating of fluoropolymer having recurring units containing polar functional groups and a second coating of fluoropolymer having recurring units containing no polar functional groups surrounding the first coating.

In another embodiment, the present invention is directed to a process for coating string, comprising applying a first solution of a first fluoropolymer containing recurring units having polar functional groups to a string to form a coated string, drying said first solution, applying a second solution of a second fluoropolymer containing recurring units having no polar functional groups to the coated string and drying said second solution.

In another embodiment, the present invention is directed to a composite string comprising a multitude of strands, wherein the surfaces of said strands are interspersed with particles of fluoropolymer.

DETAILED DESCRIPTION OF THE INVENTION

The present invention is directed to coatings for monofilament, multifilament, spun fiber, metal, natural material strings, and combinations thereof to provide for their easy stringing, as for example in the stringing of sports racquets, easy adjustment, and superior properties in use.

"String" as the term is used in this-invention-includes-monofilament and multifilament strings, and composite strings, as for example strings for sports racquets, including tennis racquets, badminton racquets, squash racquets and racquetball racquets, which may be composed of a central monofilament or multifilament strand around which are wound or braided smaller mono- or multifilament strands, and possibly jacketed with a layer of polymer or other material. Strings may be made of natural or synthetic materials or combinations of natural and synthetic materials. Nylon, used here as a general name for the class of polymers known as polyamides, is among the materials used in tennis racquet strings as the central strand. The natural product called "gut" and derived from animal sources is also used for strings according to the present invention. Glass and metal strings may be used in certain applications in sporting equipment or musical devices.

"Fluoropolymer" as the term is used this invention includes polymers in which at least one of the recurrent units, also known as the component monomers, contains at least one covalently bonded fluorine atom. Such fluoropolymers include polymers formed from one or more of the fluoromonomers vinyl fluoride; vinylidene fluoride ($VF_2$); trifluoroethylene; chlorotrifluoroethylene (CTFE); 1,2-difluoroethylene; tetrafluoroethylene (TFE); hexafluoropropylene (HFP); perfluoro(alkyl vinyl ethers) such as perfluoro (methyl vinyl ether) (PMVE), perfluoro(ethyl vinyl ether) (PEVE), and perfluoro(propyl vinyl ether) (PMVE); perfluoro(1,3-dioxole); perfluoro(2,2-dimethyl-1,3-dioxole) (PDD); perfluoro(butenyl vinyl ether); $F(CF_2)_nCH_2OCF{=}CF_2$ wherein n is 1, 2, 3, 4, or 5; $R_4CH_2OCF{=}CF_2$ wherein $R_4$ is hydrogen or $F(CF_2)_m$- and m is 1, 2 or 3; and $R_5OCF{=}CH_2$ wherein $R_5$ is $F(CF_2)_z$— and z is 1, 2, 3, or 4; perfluorobutyl ethylene (PFBE); 3,3,3-trifluoropropene and 2-trifluoromethyl-3,3,3-trifluoro-1-propene. Preferred fluoromonomers include TFE, HFP, PMVE, PEVE, PPVE, 2-trifluoromethyl-3,3,3-trifluoro-1-propene, PFBE, vinyl fluoride, vinylidene fluoride, CTFE, and PDD. The fluoromonomers may be polymerized with one or more other fluoromonomers or other monomers, such as hydrocarbon monomers that are not fluoromonomers, to make copolymer. If copolymer is to be made, the monomers chosen must be able to copolymerize. Fluorine-free monomers that copolymerize with some combinations of fluoromonomers include propylene and ethylene. One example of such a copolymer is ethylene/tetrafluoroethylene (ETFE).

"Monomer having a polar functional group" as the term is used here includes monomer that will copolymerize with fluoromonomers and that also has at least one acidic or basic or hydroxylic group attached or a group which can be converted to an acidic or basic or hydroxylic group by hydrolysis, reaction with ammonia or amines, oxidation, or reduction, with or without the additional presence of catalysts for such reactions. Polar functional groups are distinguished by their affinity for other polar molecules such as water, alcohols, amines, and polar polymers, such as polyamides, and for polymers which can be made to react with polar groups. Polyesters are an example of such polymers. Preferred monomers containing a polar functional group include maleic anhydride, maleic acid, fumaric acid, dichloromaleic anhydride, dichloromaleic acid, or salts of these acids, $CF_2{=}CFOCF_2CF(CF_3)OCF_2CF_2X$ wherein X is $SO_2F$, $CO_2H$, $CO_2CH_3$, $CH_2OH$, $CH_2OCN$ or $CH_2OPO_3H$, and $CF_2{=}CFOCF_2CF_2SO_2F$ and combinations thereof. When X is $SO_2F$, hydrolysis, preferably alkaline hydrolysis, is desirable to convert the groups to $SO_3^-$, the sulfonate of the metal cation characteristic of the hydrolysis solution. The sulfonate salt can be converted to the sulfonic acid by ion exchange. The sulfonic acid form is the preferred form. More preferred monomers containing a polar functional group are maleic anhydride, maleic acid, dichloromaleic anhydride, dichloromaleic acid. The most preferred monomer containing a polar functional group is maleic anhydride (MAn).

Preferred polymers of the first coating are polymers containing $VF_2$ and HFP plus the monomer containing a polar functional group. The monomer containing a polar functional group is preferentially MAn. Such polymers and their preparation are described in European Patent Application 0 911 347 A2. To ensure that the polymers are soluble at or near room temperature, it is desirable that the polymers have little or no crystallinity, that is, that the polymers be amorphous, as described in U.S. Pat. No. 5,637,663. When the $VF_2$ content of the preferred polymer is less than about 60 mole %, solutions that are stable at room temperature can be made. As the amount of $VF_2$ in the polymer decreases, dissolution becomes easier. Preferred copolymers for the first coating have $VF_2$:HFP mole ratios in the range of about 4:6 to about 6:4 and contain about 0.1 to about 10 mole % of one of MAn, maleic acid, fumaric acid, dichloromaleic anhydride, or dichloromaleic acid, or combinations of these monomers. More preferred copolymers for the first coating have $VF_2$:HFP mole ratios in the range of about 4:6 to about 6:4 and contain about 0.5–5 mole % of MAn, maleic acid, fumaric acid, dichloromaleic anhydride, or dichloromaleic acid, or combinations thereof. Most preferred are copolymers are about 1:1 $VF_2$:HFP, and about 1–3 mole % MAn.

The polar functional group provides adhesion of the first coating polymer to the underlying string. It may do this through polar attraction between the first coating polymer and the polar groups on the string, or through reaction with the surface of the string, as for example by the polar functional groups of the first coating polymer reacting with amide groups in polyamides (nylon) to form a chemical bond, or by other means. Adhesion can be promoted by heating. Without the polar functional group in the polymer of the first coating, adhesion of the first coating to the string is low and the polymer may tend to come off the string, especially as the string is stretched and flexed, as happens under impact. An example of such impact is the impact of a tennis ball on a tennis racquet.

It is preferred that the first coating polymer be soluble in polar solvents such as acetone and Vertrel® XF ($CF_3CFHCFHCF_2CF_3$, available from DuPont). This way, when the second coating polymer is applied dissolved in a nonpolar solvent, the application of the second coating does not wash off or disturb the first coating. Solubility in polar solvents is favored by having both an amorphous polymer structure and a relatively high concentration of polar monomers such as $VF_2$ and functional groups such as maleic anhydride. Ketones are desirable polar solvents because they do not react with the polar functional groups of the polymer. Acetone is the preferred ketone because of its low cost and low toxicity.

Preferred fluoropolymers for the second coating are perfluoropolymers because of their lower coefficient of friction.

More preferred are copolymers of TFE and HFP, which are also known as FEP (fluorinated ethylene propylene) polymers. Most preferred for polymers of the second coating are polymers containing only TFE and HFP. As in the case with the polymer of the first coating, it is also desirable that the polymer of the second coating be amorphous. Such dipolymers and their preparation are described in U.S. Pat. No. 5,637,663. Preferred dipolymers for the second coating have a TFE:HFP mole ratio no greater than at least about 7:3. Molar ratios of about 6:4 to 4:6, and about 1:1 are effective.

It is further desirable that the polymers, especially the polymer of the second coating, have a glass transition temperature (Tg) near room temperature or above, preferably above room temperature. As temperature rises above the Tg, the polymers begin to soften, which leads to the disadvantageous tendency of the strings to pick up dust and grit. It is less important that the polymer of the first coating have a Tg greater than room temperature, since it will not normally be exposed to ambient conditions.

Solvents for the polymer of the second coating include the "Fluorinert" electronic liquids sold by 3M (Minnesota Mining and Manufacturing, Industrial Chemicals Division). Specifically, FC-40 and FC-75 are used. FC-40 is believed to be substantially perfluoro(tributyl amine). FC-75 is believed to be substantially perfluoro(2-butyltetrahydrofuran). Hexafluorobenzene is also suitable.

A string made according to this invention is coated with a first about 0.01 to about 10 $\mu$m thick layer of a fluoropolymer containing a recurring monomer containing a polar functional group, and a second about 0.01 to about 10 $\mu$m thick layer of fluoropolymer that contains no recurrent polar functional group. The second coating may be coated directly onto the first coating, or intervening coating layers which are compatible with the first and second fluoropolymer coatings may be coated. Preferably, the first coating is about 0.05 to about 3 $\mu$m thick, and more preferably 0.1 to 1 $\mu$m thick. The thickness of the second layer is preferably about 0.05 to about 3 $\mu$m thick, and more preferably about 0.1 to about 1 $\mu$m thick. Thin coatings have the advantage of the low coefficient of friction that is characteristic of fluoropolymers without contributing significantly to the mass of the string, which would affect the string properties such as weight, elasticity, and flexibility. Furthermore, thinner coatings are less costly because less fluoropolymer is used.

The coating process of the present invention comprises applying a first solution of a first fluoropolymer containing recurring units having polar functional groups to a string to form a coated string, drying said first solution, applying a second solution of a second fluoropolymer containing recurring units having no polar functional groups to the coated string and drying said second solution.

To facilitate the application of the thin coatings described in first and second embodiments of this invention, it is preferable that the fluoropolymers be applied from solution. It is preferable that these solutions of fluoropolymer be usable at temperatures of less than about 100° C., more preferably at temperatures of less than about 60° C., and most preferably at between about 15° C. and about 40° C. Mild temperatures permit coating of strings with little or no risk that the temperature experienced during application will cause deterioration in string properties. The strings can be coated from solution by any of the means known in the art, including dipping, spraying, wiping, and brushing. After coating, the string may be 'dried' in air by driving off the solvent to deposit the fluorocarbon onto the surface to be coated. Such drying may be accomplished with or without forced circulation, or heat may be applied to speed drying, as by heating the drying air. Some heating is beneficial because it promotes adhesion. However, the temperature should not be so high as to permanently affect the properties of the string. It is one of the advantages of the thin coatings made according to this invention that solvent is easily removed under mild conditions. After the first coating is applied and dried, the second coating is applied by the same or different means and drying is repeated. The solutions used in applying the first and second coatings need not have the same solvent. It can be beneficial if the polymer of the first coating is not soluble in the solvent used to apply the second coating so that there will be less tendency for the first coating to dissolve as the second coating is applied.

In coating the inside portions of a composite string to facilitate the motion of one layer with respect to another, individual components, i.e. the component strands of the string, may be coated before the construction of the string is begun, or the partially finished string may be coated, or the finished string may be coated or impregnated, so as to ensure penetration of the coating to the first part of the composite string. Coatings on the interior portions of composite strings are not subject to the same degree of abrasion as coatings on the exterior surfaces, and should the coating tend to separate from the strand surfaces, it is likely to be retained by the jacket surrounding the core and the filaments wound around it, and to continue to promote their easy relative movement. Therefore it is often sufficient to use a single layer of fluoropolymer that contains no recurrent polar functional group.

Another approach to coating the inside portion of a multilayer string is to use TEFLON® resin dispersion (available from the DuPont Co., Wilmington, Del., USA). Applied as a liquid, it dries to leave particles of TEFLON® resin interspersed between the component strands which will be retained in the interior portion of the composite string and act to lubricate the relative motion of the component strands. Adhesion to the surfaces will be poorer than in the case of amorphous fluoropolymer applied from solution, but because the particles are in the interior of the string, they are not easily lost and can promote smooth relative movement of the string components. Polymers for this application need not be amorphous. In fact, homopolymers of TFE is preferred for its low cost relative to copolymers, its availability in dispersion form, and as having the lowest coefficient of friction in the family of fluoropolymers.

Test Methods

Performance of the coated strings is measured in a tennis racquet under playing conditions by casual players and by professionals. Evaluation is based on a) how much longer the player feels the tennis ball is staying on the racquet during a stroke, and whether the racquet makes playing easier; b) how well the racquet performs when the ball rebounds from the racquet near the edges; c) the feel when the ball hits the racquet at a relative angle of 45° to the strings and at an angle or 40 to 50° to the plane of the racquet face; and d) the ease with which spin can be applied to the ball. Durability is measured by how long the racquet maintains its improved performance.

Coating thickness is measured using scanning electron microscopy (SEM) on a cross-section of the coated string.

EXAMPLES

The polymers used in the examples are made as follows. The polymer containing the recurring unit from monomer having a polar functional group is designated Polymer A, and is made according to the method of Example 5 of European Patent Application 0 911 347 A2. It is 47.4 mole % $VF_2$, 51.0 mole % HFP, and 1.6 mole % MAn. Polymer A is used as a 3 wt. % solution in acetone.

The polymer that contains no monomer having a polar functional group is designated Polymer B, and is made according to the method of Example 1 of U.S. Pat. No. 5,637,663. It is 43 mole % HFP and 57 mole % TFE. Polymer B is used as a 5% solution in FC-40.

Example 1

This example shows how a length of nylon string is coated in a small-scale batch process. A length of nylon string sufficient for the complete stringing for one tennis racquet is coiled to a 5-inch (127 mm) diameter. This coil is totally immersed in a 3 wt. % acetone solution of Polymer A to achieve complete wetting of the surface of the string by the solution. Upon removal, excess solution is allowed to flow back into the container of Polymer A. The wet string is placed in an air oven at 80° C. (176° F.) for five to ten minutes. The polymer-coated string is removed and cooled to room temperature. A sample of the string is cut to provide a cross-section, which is subjected to SEM to determine coating thickness. Measurements at magnifications of 20,000 to 30,000 times show the thickness of the first coating to be 0.1 $\mu$m.

Then the coiled and coated string is totally immersed in a 5 wt % FC-40 solution of Polymer B to achieve complete wetting. A similar drying step at 80° C. (176° F.) is conducted. After removal from the oven and cooling to room temperature, the coated string is ready to be placed into a tennis racquet. A sample of the string is cut to provide a cross-section, which is subjected to SEM to determine coating thickness. Measurements at magnifications of 20,000 to 30,000 times show the thickness of the first coating plus the second coating to be 0.3 $\mu$m. Because the first coating is 0.1 $\mu$m thick, the second coating is determined to be 0.2 $\mu$m thick.

The racquet is strung, it being noted that stringing proceeds more easily than is the case when uncoated string is used. The racquet shows improved performance when tested by several players.

Comparative Example A

Example 1 is repeated with omission of the application of the Polymer A layer. The thickness of the Polymer B coating is about 0.2 $\mu$m. In use the racquet strung with this string shows little if any improvement initially and within a short time is indistinguishable from a racquet strung with uncoated string. It is believed that the adhesion of Polymer B alone to the string is too weak to survive the stretching and flexing of the racquet strings under the stress of stringing, and under the impact of the tennis ball. As a result the coating comes off.

Example 2

This example shows how a length of nylon string is coated in a continuous process. A continuous length of tennis racquet string is passed through a 3 wt. % acetone solution of Polymer A. Excess solution is allowed to flow back on the string into the Polymer A bath. The string is dried in a vertical tubular air oven heated to an appropriate temperature for the speed employed. The solvent removed is reclaimed in a cold trap. The string passes through an air blast system to cool it to room temperature before it is coiled onto a spool.

This process is repeated with the coated string passing through the curing equipment after being coated in an FC-40 solution of Polymer B. This solvent is also trapped and reclaimed. This prepared string is then ready for cutting to the appropriate length and packaged for sale or use. This process prepares a tennis racquet string having a more uniform coating than the manual method described in Example 1.

Example 3

This example shows how a composite string is coated internally to facilitate the relative motion of the components. The finished string is made up a central nylon core about 0.034 inch (0.86 mm) in diameter, surrounded by about 30 nylon filaments of 1.8 mils (45 $\mu$m) in diameter wound helically, the whole being jacketed with a 2 mil (50 $\mu$m) thick layer of nylon. The core and the filaments are coated first with Polymer A solution and then with Polymer B solution according to the method of Example 1. The composite string is assembled, and the exterior jacket applied, it being observed that assembly proceeds more smoothly to give a better appearing string because of the low friction between the components. A tennis racquet strung with the treated composite string is observed to be more resilient and easier to use, with better control of the ball.

Example 4

Like Example 3, this example shows how a composite string is coated internally to facilitate motion of the components. In this example an aqueous PTFE dispersion known as TEFLON® resin dispersion K-20 (35% solids, available from the DuPont Company, Wilmington Del., USA) is coated on the string components. K-20 is diluted to a viscosity suitable to the coating method. The dispersion is then applied to the nylon core and the coating is air dried. The filaments are then wound around the core, and a second coating of the diluted K-20 dispersion is applied, and air dried. The exterior jacket is applied, it being observed that assembly proceeds more smoothly to give a better appearing string because of the low friction between the components. As in the of Example 3, improved performance is noted by players using a racquet strung with this string.

Example 5

Strings from Examples 3 and 4 are further treated by the method described in Example 1 to give the exterior surface of the strings a low coefficient of friction coating of fluoropolymer. The performance of racquets strung with these strings is superior to the racquets described in Examples 3 and 4, and better than the racquet in Example 1, in which only the exterior surface of the string was coated.

Example 6

The uncoated strings of a tennis racquet are sprayed with a 3 wt. % acetone solution of Polymer A, air dried till dry to the touch, and then further dried by blowing hot air from a hair dryer upon it. A spray coating of FC-40 solution of Polymer B is then applied and dried in air till dry to the touch. Further drying is done with a hair dryer. The racquet strings are slightly displaced by hand to break any bonding that may have occurred at the string intersections. No bonding is observed. Improved performance is noticed when the racquet is put into play. This coating method is suitable for racquets and other stringed devices that are assembled using uncoated strings.

Example 7

Example 6 is repeated but the racquet is first put in a jig which slightly displaces the string so as to expose the points at which they normally intersect. This is done to ensure that the points at which the strings intersect, that is, the points at which low coefficient of friction is most beneficial, are exposed to the sprayed coating. Improved performance is noticed when the racquet is put into play.

The examples above disclose the superior properties of sports strings coated according to the present invention. It is expected that such coated strings will exhibit improved longevity when used in either sports or musical applications, due to the decreased coefficients of friction effected by the fluoropolymer coatings.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A coated string comprising;

(a) a first coating of fluoropolymer having recurring units containing polar functional groups coated on the string and adhered thereto; and (b) a second coating of fluoropolymer having recurring units containing no polar functional groups surrounding the first coating.

2. The coated string of claim 1 wherein the fluoropolymers of the first and second coatings are amorphous.

3. The coated string of claim 1 wherein the first and second coatings are independently about 0.01 to about 10 $\mu$m thick.

4. The coated string of claim 1 wherein the polar functional groups of the fluoropolymer of the first coating are derived from monomers selected from the group consisting of maleic anhydride, maleic acid, fumaric acid, dichloromaleic anhydride, dichloromaleic acid, or salts of these acids, $CF_2{=}CFOCF_2CF(CF_3)OCF_2CF_2X$ (wherein X is $SO_2F$, $CO_2H$, $CO_2CH_3$, $CH_2OH$, $CH_2OCN$ or $CH_2OPO_3H$) $CF_2{=}CFOCF_2CF_2SO_2F$ and combinations thereof.

5. The coated string of claim 1 wherein the fluoropolymer of the first coating is a copolymer of vinylidene fluoride, hexafluoropropylene and maleic anhydride having a molar ratio of vinylidene fluoride:hexafluoropropylene from about 4:6 to about 6:4 and containing about 0.1 to about 10 mole % maleic anhydride.

6. The coated string of claim 1 wherein the fluoropolymer of the second coating is a copolymer of tetrafluoroethylene and hexafluoropropylene in a molar ratio of from 7:3 to 3:7.

7. The coated string of claim 1 wherein the fluoropolymer of the second coating is an amorphous copolymer of tetrafluoroethylene and perfluoro(2.2-dimethyl-1,3-dioxole).

8. The coated string of claim 1 wherein the first and second coatings are independently about 0.05 to about 3 $\mu$m thick.

9. The coated string of claim 1 wherein the first and second coatings are applied from solution.

10. The coated string of claim 1 wherein said coated string is a sports racquet string.

11. The coated string of claim 10 wherein said sports racquet string is a tennis racquet string.

12. A composite string having component strands, wherein said component strands are coated with fluoropolymer coating.

13. A composite string comprising a multitude of strands, wherein the surfaces of said strands are interspersed with particles of fluoropolymer.

* * * * *